US011939771B2

(12) United States Patent
Cluck

(10) Patent No.: US 11,939,771 B2
(45) **Date of Patent: *Mar. 26, 2024**

(54) INSULATED ROOF SYSTEMS, SUPPORT MEMBERS THEREOF, AND METHOD OF INSTALLING

(71) Applicant: NUCOR CORPORATION, Charlotte, NC (US)

(72) Inventor: Brian K. Cluck, Lebanon, TN (US)

(73) Assignee: NUCOR CORPORATION, Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/085,663

(22) Filed: Dec. 21, 2022

(65) Prior Publication Data

US 2023/0124637 A1 Apr. 20, 2023

Related U.S. Application Data

(63) Continuation of application No. 17/205,024, filed on Mar. 18, 2021, now Pat. No. 11,536,034.

(60) Provisional application No. 62/994,952, filed on Mar. 26, 2020.

(51) Int. Cl.
*E04D 13/16* (2006.01)
*E04D 3/36* (2006.01)

(52) U.S. Cl.
CPC ..... *E04D 13/1618* (2013.01); *E04D 3/36* (2013.01)

(58) Field of Classification Search
CPC ..... E04D 13/1618; E04D 3/36; E04D 3/3601
See application file for complete search history.

(56) References Cited

U.S. PATENT DOCUMENTS

| | | | |
|---|---|---|---|
| 3,513,614 | A | 5/1970 | Studzinski |
| 4,058,949 | A | 11/1977 | Bellem |
| 4,081,938 | A | 4/1978 | Bertacchi et al. |
| 4,248,021 | A | 2/1981 | Dyer |
| 4,263,763 | A | 4/1981 | Bouwens |
| 4,266,384 | A | 5/1981 | Orals et al. |
| 4,279,112 | A | 7/1981 | Bertrand |
| 4,314,428 | A | 2/1982 | Bromwell |

(Continued)

FOREIGN PATENT DOCUMENTS

| | | | |
|---|---|---|---|
| AU | 2013101205 | A4 | 10/2013 |
| CN | 203475728 | U | 3/2014 |

(Continued)

*Primary Examiner* — Beth A Stephan
(74) *Attorney, Agent, or Firm* — Moore & Van Allen PLLC; Jeffrey R. Gray

(57) ABSTRACT

Support members for a roof system are provided to allow for positioning panels of a roof apart from building members so that building components, such as insulation may be placed between the roof panels and the building members. The support members may be utilized in new buildings or to retrofit existing buildings. Each of the support members may comprise a single support member that has a base portion operatively coupled to an offset portion that is operatively coupled to an upper portion. One or more channels may be provided in the base portion, offset portion, and/or the upper portion to provide structural support and to allow the support members to be operatively coupled to each other and other building members without the need for additional components.

20 Claims, 10 Drawing Sheets

(56) References Cited

U.S. PATENT DOCUMENTS

| | | | |
|---|---|---|---|
| 4,329,823 | A | 5/1982 | Simpson |
| 4,346,543 | A | 8/1982 | Wilson et al. |
| 4,391,075 | A | 7/1983 | Musgrave |
| 4,441,294 | A | 4/1984 | Riley |
| 4,446,664 | A | 5/1984 | Harkins |
| 4,453,361 | A | 6/1984 | Hulsey |
| 4,543,760 | A | 10/1985 | Barker et al. |
| 4,578,917 | A | 4/1986 | Brobst |
| 4,594,823 | A | 6/1986 | Hague |
| 4,597,234 | A | 7/1986 | Simpson |
| 4,642,961 | A | 2/1987 | Cruise |
| 4,651,489 | A | 3/1987 | Hodges et al. |
| 4,691,482 | A | 9/1987 | Heinemann et al. |
| 4,691,491 | A | 9/1987 | Lilley |
| 4,747,249 | A | 5/1988 | Bell et al. |
| 4,791,770 | A | 12/1988 | Bell, III et al. |
| 4,982,542 | A | 1/1991 | Funaki |
| RE33,566 | E | 4/1991 | Heckelsberg |
| 5,119,612 | A | 6/1992 | Taylor et al. |
| 5,857,292 | A | 1/1999 | Simpson |
| 5,911,663 | A | 6/1999 | Eidson |
| 8,621,805 | B2 | 1/2014 | Mcclure |
| 8,713,884 | B2 | 5/2014 | Musick et al. |
| 9,580,909 | B2 | 2/2017 | Hostetler et al. |
| 9,725,903 | B2 | 8/2017 | Hostetler et al. |
| 11,536,034 | B2 * | 12/2022 | Cluck ..... E04D 13/1618 |
| 2011/0078973 | A1 | 4/2011 | Oberg |
| 2011/0094175 | A1 | 4/2011 | Groft |
| 2011/0173913 | A1 | 7/2011 | Bodsford et al. |
| 2012/0174502 | A1 | 7/2012 | Oberg |
| 2015/0082725 | A1 | 3/2015 | Beals |

FOREIGN PATENT DOCUMENTS

| | | | |
|---|---|---|---|
| CN | 104196183 | A | 12/2014 |
| CN | 204199556 | U | 3/2015 |
| WO | 9954569 | A1 | 10/1999 |

* cited by examiner

INSULATED ROOF SYSTEMS, SUPPORT MEMBERS THEREOF, AND METHOD OF INSTALLING

CROSS REFERENCE AND PRIORITY CLAIM

The present application for a patent claims priority to U.S. Pat. No. 11,536,034 entitled "INSULATED ROOF SYSTEMS, SUPPORT MEMBERS THEREOF, AND METHOD OF INSTALLING", filed on Mar. 18, 2021, which claims priority to U.S. Provisional Patent Application Ser. No. 62/994,952 entitled "INSULATED ROOF SYSTEMS, SUPPORT MEMBERS THEREOF, AND METHOD OF INSTALLING" filed on Mar. 26, 2020, both of which are assigned to the assignees hereof and hereby expressly incorporated by reference herein.

FIELD

This application relates generally to the field of insulated roofing systems, components thereof, and methods of installing. More particularly to a plurality of support members that are operatively coupled to each other to provide space between structures for components, such as insulation.

BACKGROUND OF THE INVENTION

Buildings that utilize metal decking are typically large area, open floor steel frame buildings. The buildings typically are pre-engineered and are provided as kits of components for use in a wide range of industries, including agricultural, aircraft hangers, garages, riding arenas, indoor sports fields, warehouses, as well as commercial and governmental buildings. Steel buildings may feature open floor space, referred to as bays, and are commonly but not always, built on poured concrete slabs. Building members may comprise columns, beams, rafters, purlins, joists, girts, bracing, or the like. Vertical columns may be operatively coupled to the concrete slabs and extend from the concrete. The vertical columns may be operatively coupled to and support elongated rafters or trusses. Long bay purlins or joists may be operatively coupled to the rafters or trusses in a transverse orientation to the rafters. A plurality of roof panels may be operatively coupled to the purlins or joists with clips, such as standing seam clips. Typically, the clips provide a gap between the purlin or joists and the roof panels. Frequently, the gap is filled with insulation components and/or other building components to reduce heat transfer through the roof panels. There is a need to provide improved roof systems.

SUMMARY OF THE INVENTION

The embodiments of the present disclosure meet the needs discussed above. This is achieved by providing support members for roof systems, which enable positioning of roof panels of a roof apart from building members (e.g., roof building members). The space created by the support members allow building components such as insulation, to be placed between the roof panels and the roof building members. In some embodiments, each of the support members may be comprised of a single channeled component having three main portions. A first portion being a base portion (e.g., otherwise described as a foot portion), used to attach the support member to the roof building members. The second portion being an offset portion, used to increase the displacement between the roof panels and roof building members. The third portion being an upper portion, which is used to support the roof panel attachment via roof clips, as well as connecting adjacent support members. In alternative embodiments, as will be described in further detail herein, the channel may be continuous (as shown) or may be discontinuous, and the support member may have more than one channel. The support members may be utilized in new buildings or to retrofit existing buildings.

The roof system described herein improves upon traditional roof systems by improving the thermal resistance of traditional roof system. As such, embodiments of the roof system described herein achieves compliance with updated energy codes by way of using the support members. The support members described herein provide a larger gap for insulating components (e.g., compressible insulation, spray insulation, insulating thermal blocks, or the like) or other like building components. Consequently, the roof system with the support members described herein achieve the required thermal resistance for compliance with the energy codes while providing better, the same, or similar structural support and costs for production, transportation, and installation.

Embodiments of the invention comprise a support member for a roof system. The support member comprises a base portion, an upper portion, and an offset portion operatively coupling the base portion and the upper portion. The base portion, the upper portion, or the offset portion comprises a channel.

In further accord with embodiments, the channel extends from the base portion through the offset portion and into the upper portion.

In other embodiments, the support member is a stamped part.

In yet other embodiments, the channel comprises a lower channel flange, two upper channel flanges, and two webs operatively coupling the lower channel flange to the two upper channel flanges.

In still other embodiments, the channel comprises a first upper channel flange and a second upper channel flange, a first web and a second web, and a lower channel flange. The first web operatively couples the lower channel flange and the first upper channel flange, and the second web operatively couples the lower channel flange to the second upper channel flange.

In other embodiments, the channel is within the base portion, and wherein the channel diverges within the base portion.

In further accord with embodiments, a base portion width of the base portion is greater than an upper portion width of the upper portion or an offset portion width of the offset portion.

In other embodiments, the offset portion is operatively coupled to the upper portion through an upper radiused bend.

In still other embodiments, the offset portion is operatively coupled to the base portion through a lower radiused bend.

In yet other embodiments, the support member comprises a proximal end and a distal end. The distal end of the support member is configured for operative coupling with a proximal end of a second support member adjacent the support member.

In other embodiments, the proximal end comprises a nested end. The nested end comprises a nested channel. The nested channel comprises a nested lower channel flange, a first nested upper channel flange and a second nested upper channel flange, and a first nested channel web and a second nested channel web. The first nested channel web operatively couples the nested lower channel flange and the first nested upper channel flange. The second nested channel web operatively couples the lower nested channel flange to the second nested upper channel flange. The nested lower channel flange has a lower nested flange width that is less than a lower channel flange width of the lower channel flange.

Embodiments of the invention comprise a roof system comprising a plurality of building members, and a plurality of support members operatively coupled to at least one of the plurality of building members. Each of the plurality of support members comprise a base portion, an upper portion, and an offset portion operatively coupling the base portion and the upper portion. The base portion, the upper portion, or the offset portion comprise a channel. A distal end of a first support member is operatively coupled to a proximal end of a second support member adjacent the first support member.

In further accord with other embodiments, the channel extends from the base portion through the offset portion and into the upper portion.

In other embodiments, the channel comprises a lower channel flange, two upper channel flanges, and two webs operatively coupling the lower channel flange to the two upper channel flanges.

In yet other embodiments, the channel comprises a first upper channel flange and a second upper channel flange, a first web and a second web, and a lower channel flange. The first web operatively couples the lower channel flange and the first upper channel flange. The second web operatively couples the lower channel flange to the second upper channel flange.

In still other embodiments, the channel is within the base portion, and the channel diverges within the base portion.

In other embodiments, the offset portion is operatively coupled to the upper portion through an upper radiused bend and the offset portion is operatively coupled to the base portion through a lower radiused bend.

In further accord with embodiments, operatively coupling of the distal end of the first support member to the proximal end of the second support member comprises operatively coupling at the upper portion of the first support member and the upper portion of the second support member.

In other embodiments, the proximal end comprises a nested end. The nested end comprises a nested channel. The nested channel comprises a nested lower channel flange, a first nested upper channel flange and a second nested upper channel flange, and a first nested channel web and a second nested channel web. The first nested channel web operatively couples the nested lower channel flange and the first nested upper channel flange. The second nested channel web operatively couples the lower nested channel flange to the second nested upper channel flange. The nested lower channel flange has lower nested flange width that is less than a lower channel flange width of the lower channel flange. The nested channel at the proximal end of the second support member nests within the channel at the distal end of the first support member.

Embodiments of the invention comprise a method of installing a roof system. The method comprises assembling a plurality of support members to a building member. The plurality of support members comprises a base portion, an upper portion, and an offset portion operatively coupling the base portion and the upper portion. The base portion, the upper portion, or the offset portion comprises a channel. The proximal end of each of the plurality of support members is operatively coupled to a distal end of an adjacent support member of the plurality of support members. The method further comprises assembling first insulation between the plurality of support members and the building member and assembling second insulation above the plurality of support members. The method also comprises assembling a plurality of clips to the plurality of support members and assembling a plurality of panels to the plurality of clips.

The features, functions, and advantages that have been discussed may be achieved independently in various embodiments of the present invention or may be combined in yet other embodiments, further details of which can be seen with reference to the following description and drawings.

BRIEF DESCRIPTION OF THE DRAWINGS

The foregoing and other advantages and features of the invention, and the manner in which the same are accomplished, will become more readily apparent upon consideration of the following detailed description of the invention taken in conjunction with the accompanying drawings, which illustrate some embodiments of the invention and which are not necessarily drawn to scale, wherein.

DETAILED DESCRIPTION

Figure 1:
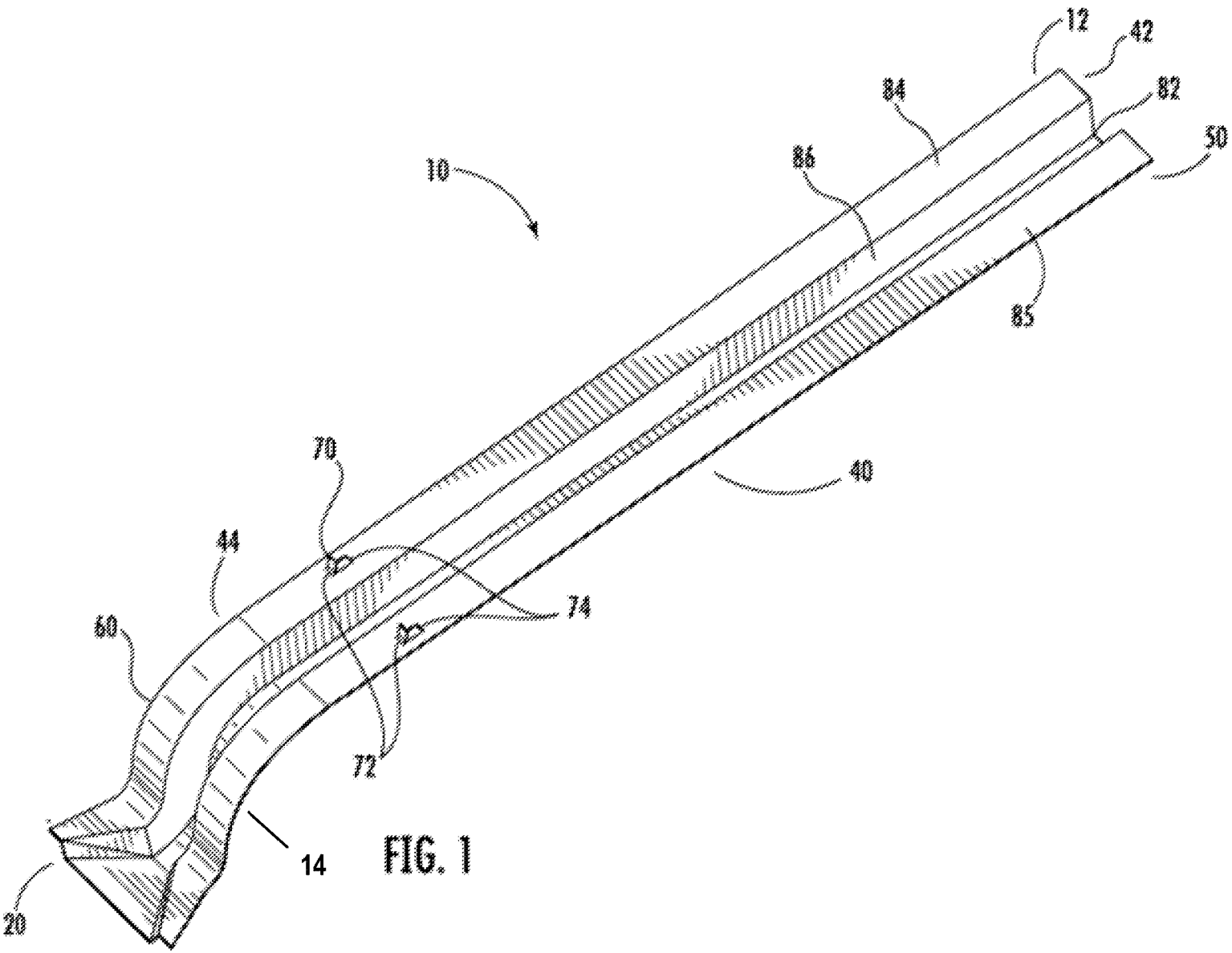
FIG. 1 illustrates a perspective view of a support member, in accordance with embodiments of the present disclosure.
Figure 2:
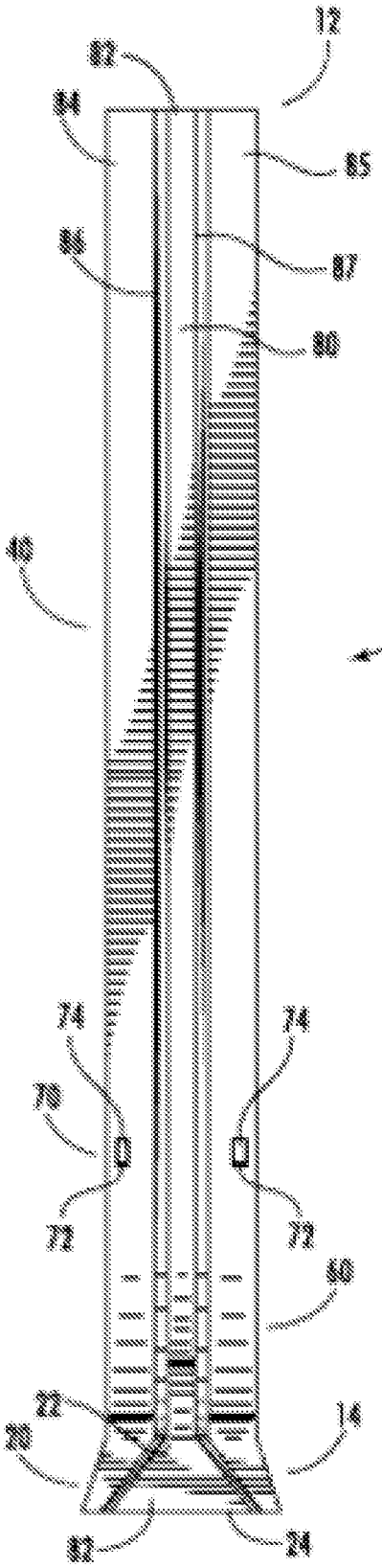
FIG. 2 illustrates a top view of a support member, in accordance with embodiments of the present disclosure.
Figure 3:
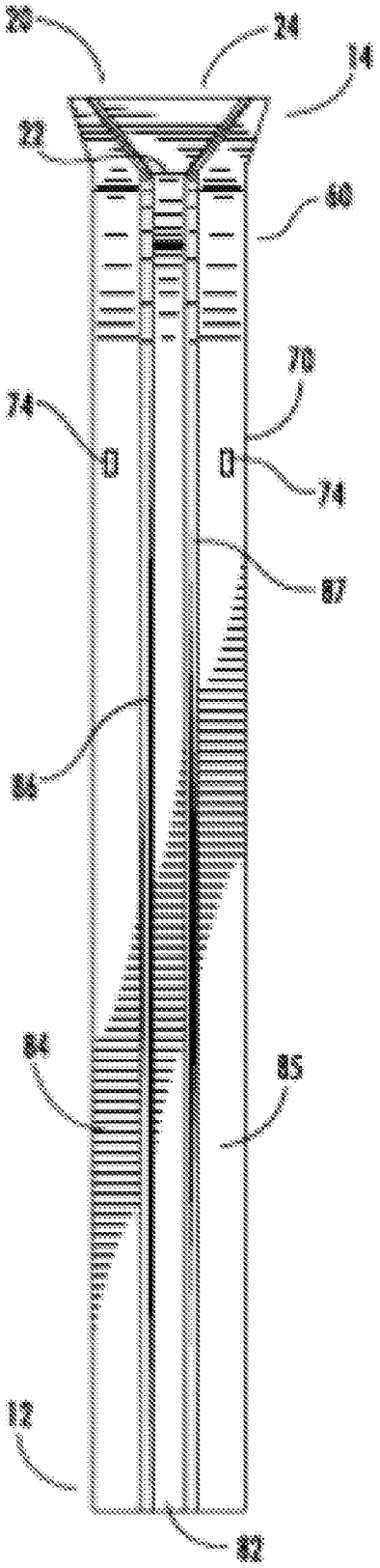
FIG. 3 illustrates a bottom view of a support member, in accordance with embodiments of the present disclosure.

Embodiments of the present invention will now be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

FIGS. 1 through 11 illustrate a support member 10 for a roof system 100 (e.g., roof insulation system 100). The support member 10 may comprise a proximal end 12 and a distal end 14. The support member 10 comprises a base portion 20 and an upper portion 40, wherein the base portion 20 is operatively coupled to the upper portion 40 through an offset portion 60. The base portion 20 may be adjacent the distal end 14 of the support members 10, while the proximal end 12 may be formed by the upper portion 40 of the support members 10.

As will be described in further detail herein, the base portion 20, the upper portion 40, and/or the offset portion 60 may comprise a one or more channels 80 (illustrated in the Figures as a single continuous channel). It should be understood that the one or more channels 80 may extend from the base portion 20, through the offset portion 60, and through the upper portion 40 of the support member 10. In the illustrated embodiments in FIGS. 1 through 11, a single channel 80 is utilized. The channel 80 may comprise a lower channel flange 82 operatively coupled to two upper channel flanges 84, 85 through the use of two webs 86, 87. It should be understood that the lower channel flange 82 may be parallel, generally parallel, or substantially parallel with the upper channel flanges 84, 85. For example, lower channel flange 82 may be parallel to the upper channel flanges 84, 85 along the length of the channel 80. It should be further understood that the webs 86, 87 may be parallel, generally parallel, or substantially parallel with each other. The webs 86, 87 may extend from, and operatively couple, the lower channel flange 82 to the upper channel flanges 84, 85. In some embodiments, the webs 86, 87 may diverge from the lower channel flange 82 outwardly to the upper channel flanges 84, 85. However, in some embodiments the webs 86,87 may coverage instead of diverging. The channel 80 may be any type of shape, such as u-shaped, v-shaped, c-shaped, or the like.

With respect to the channel 80 within the base portion 20, it should be further understood that a channel width of the channel 80 may diverge from a first base end 22 adjacent the offset portion 60 as the channel 80 extends to the second base end 24. As such, the width of the two upper channel flanges 84, 85 in the base portion 20 may coverage and/or be less than the width of the two upper channel flanges 84, 85 in the offset portion 60 and/or the upper portion 40. In other embodiments, the two upper channel flanges 84, 85 in the base portion 20 may have the same width as the upper channel flanges 84, 85 in the upper portion 40 and/or the offset portion 60 of the support members 10. In alternative embodiments, the channel width itself of the channel 80 may converge from a first base end 22 as the channel 80 extends to the second base end 24. Accordingly, the two upper channel flanges 84, 85 in the base portion 20 may diverge and/or be greater than the width of the two upper channel flanges 84, 85 in the offset portion 60 and/or the upper portion 40.

As will be described in further detail with respect to the installation system 100, the base portion 20 is configured for operative coupling with a building member 200. In some embodiments, the base portion 20 may have one or more apertures therethrough (e.g., in the lower channel flange 82 of the channel 80 in the base portion, or the like) that are configured to receive fasteners 110 (e.g., rivets, pins, rods, bolts, screws, or the like) for operatively coupling the base portion 20 of the support member 10 to the building member 200. In some embodiments, the base portion 20 may have a base width that is greater than the width of the upper portion 40 and/or the offset portion 60 of the support member 10 in order to facilitate a larger surface for operatively coupling the base portion to the building members 200 (e.g., purlins, or the like).

As illustrated in FIGS. 1 through 7, the upper portion 40 may comprise a first upper end 42 and a second upper end 44. The first upper end 42 may form the proximal end 12 of the support member 10 and may comprise a coupling end for operative coupling with adjacent support members 10. Alternatively, the second upper end 44 may be operatively coupled to the offset portion 60 and/or the base portion 20, and/or may form a part of the distal end 14 of a support member 10. The coupling end may be any type of end, such as, but not limited to tabs (e.g., that are inserted into adjacent support members 10), fingers and/or slots (e.g., that slide within adjacent fingers and/or slots of adjacent support members 10), an interlocking feature, a nested portion 50 as will be described in further detail herein, or the like. The first upper end 42, in some embodiments, may be operatively coupled to another portion adjacent the distal end 14 of an adjacent support member (e.g., to the base portion 20, the offset portion 60, and/or upper portion 40).

Figure 9:
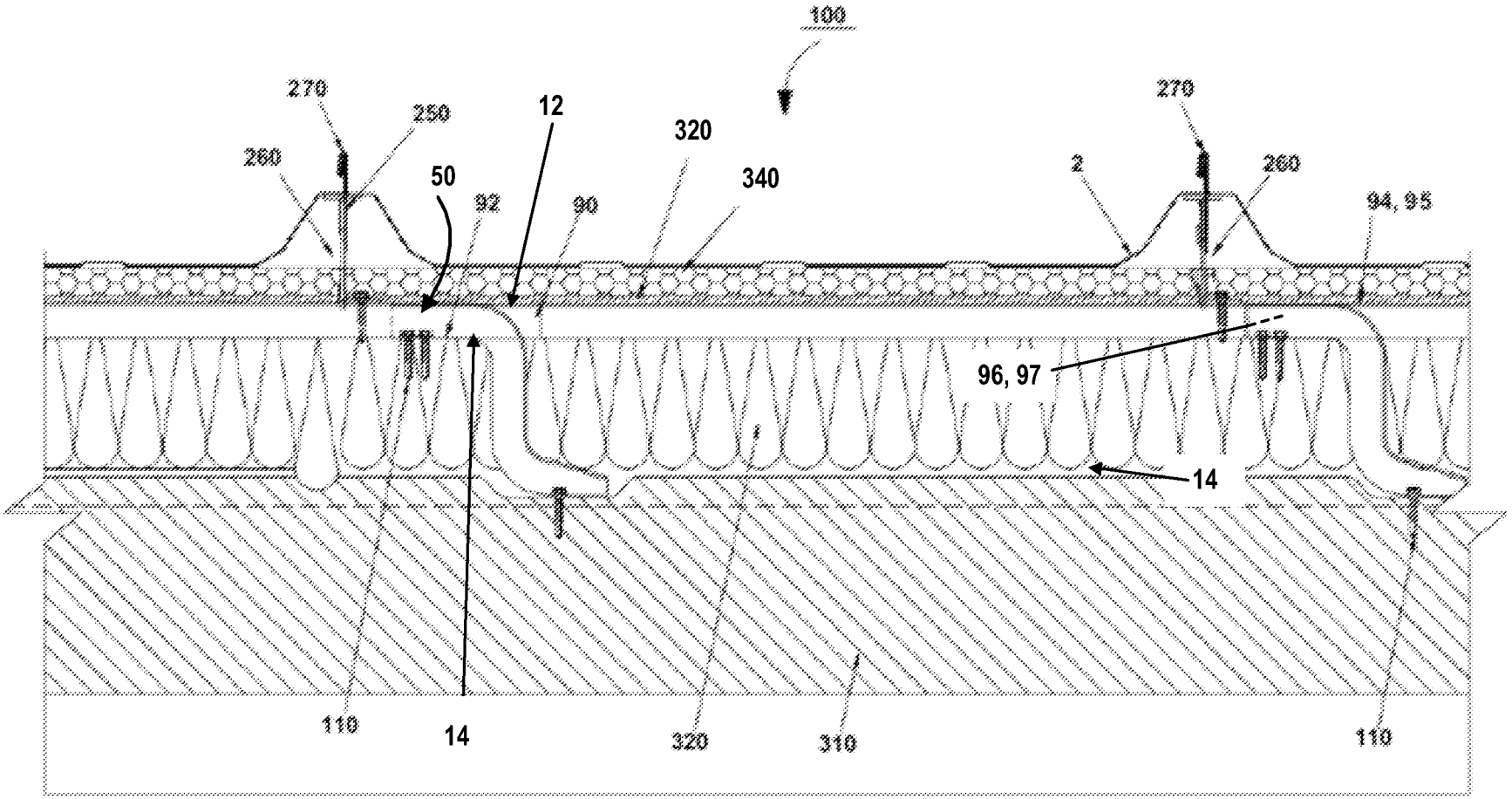
FIG. 9 illustrates a cross-sectional side view of a roof insulation system with a plurality of support members installed, in accordance with embodiments of the present disclosure.

The nested portion 50 described above may be configured for being nested inside of the channel 80 of an adjacent support member 10 (e.g., within a channel 80 at a distal end 14, such as a second upper end 44 of the upper portion 40 of the support member 10), as illustrated with respect to FIG. 9, which will be described in further detail herein. As such, in some embodiments the nested portion 50 at the second upper end 44 of the upper portion 40, may comprise a nested channel 90 that is smaller than the support member channel 80. For example, the nested channel 90 may comprise a nested lower flange 92 and two nested upper flanges 94, 95 that are operatively coupled to each other through nested webs 96, 97. The nested lower flange 92 of the nested channel 90 has a nested lower flange width that is less than the lower flange width of the lower flange 82 of the support member channel 80. The nested upper flanges 94, 95 and/or the nested webs 96, 97 may have the same or similar width (e.g., less than, equal to, or greater than) the width of the upper flanges 84, 85 or the webs 86, 87 of the channel 80. Consequently, in some embodiments of the invention, the nested portion 50 (e.g., nested channel 90) of a first support member 10 may nest (e.g., fit within, or the like) with the channel 80 of a second support member 10 adjacent the distal end 14 (e.g., at the second upper end 44 of the upper portion 40) of the second support member 10. In further accord with embodiments of the invention, the nested portion 50 may have one or more nested apertures that may be used along with one or more fasteners 110 in order to operatively couple the proximal end 12 (e.g., first upper end 42) of a support member 10 to the distal end 14 (e.g., second upper end 44) of an adjacent support member 10, such as through the nested portion 50 of the upper portion 40 of the support member 10.

Alternatively, or in addition to the nested portion 50 of the support member 10, the distal end 14 (e.g., the second upper end 44 of the upper portion 40 of the support member 10) may comprise an expanded portion. In some embodiments, the expanded portion may comprise an expanded channel that is larger than the support member channel 80. For example, the expanded channel may comprise an expanded lower flange and two expanded upper flanges that are operatively coupled to each other through expanded webs. The expanded lower flange of the expanded channel has an expanded lower flange width that is greater than the lower flange width of the lower flange 82 of the support member channel 80. The expanded upper flanges and/or the expanded webs may have the same or similar width (e.g., less than, equal to, or greater than) the width of the upper flanges 84, 85 or the webs 86, 87 of the channel 80. Consequently, in some embodiments of the invention, the expanded portion (e.g., with the expanded channel) may cradle (e.g., receive within, or the like) the channel 80 (e.g., standard channel 80, nested channel 90, or the like) of the support member 10 adjacent the distal end 14 (e.g., at the second upper end 44 of the upper portion 40) of the support member 10. In further embodiments of the invention, the expanded portion may have one or more expanded apertures that may be used along with one or more fasteners 110 in order to operatively couple the proximal end 12 (e.g., first upper end 42 of a support member 10) to the distal end 14 (e.g., second upper end 44 of an adjacent support member 10), such as through the expanded portion of the upper portion 40 of the support member 10.

Figure 4:
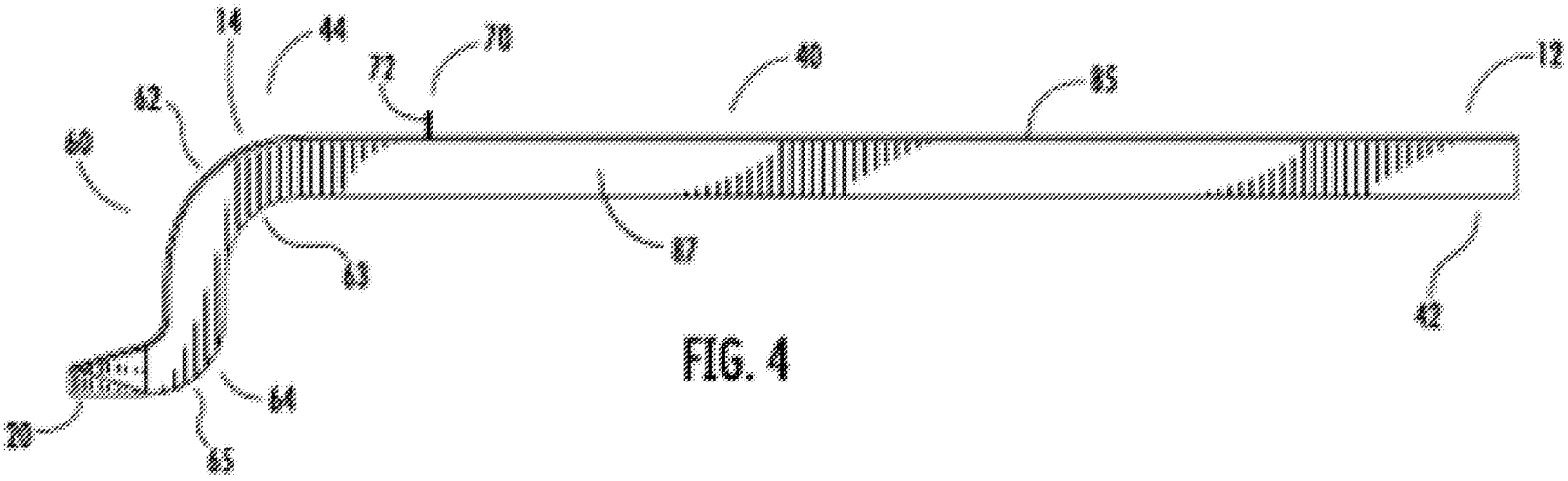
FIG. 4 illustrates a side view of a support member, in accordance with embodiments of the present disclosure.
Figure 5:
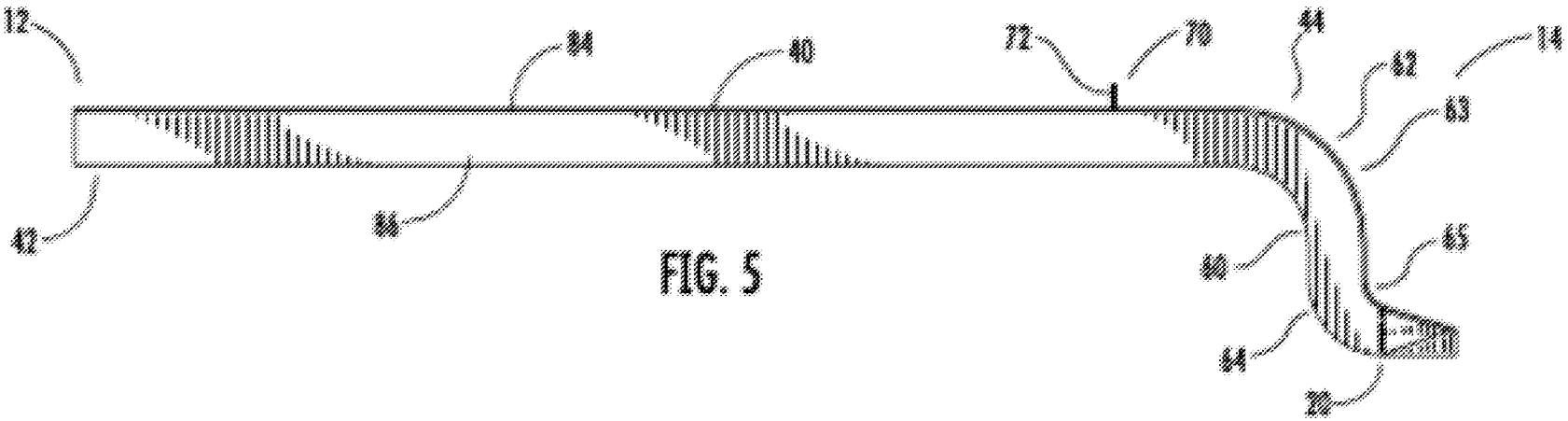
FIG. 5 illustrates an opposite side view of a support member, in accordance with embodiments of the present disclosure.
Figure 6:
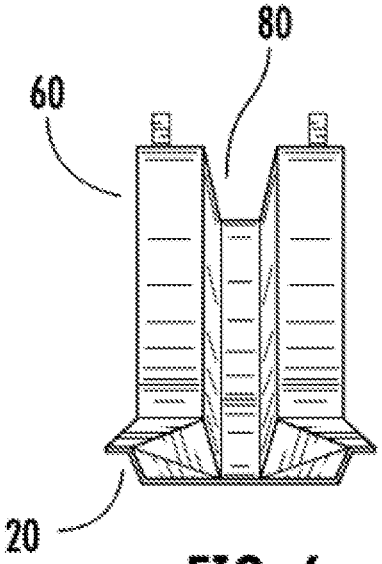
FIG. 6 illustrates a front view of the support member, in accordance with embodiments of the present disclosure.
Figure 7:
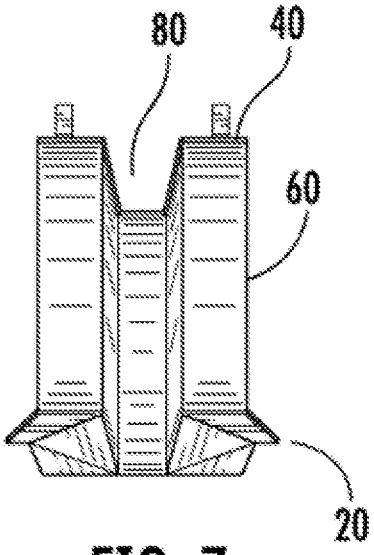
FIG. 7 illustrates a rear view of the support member, in accordance with embodiments of the present disclosure.

As illustrated in FIGS. 1, 4, and 5, the offset portion 60 may comprise a first offset end 62 and a second offset end 64. The first offset end 62 may be operatively coupled to the second upper end 44 of the upper portion 40 of the support member 10, while the second offset end 64 may be operatively coupled to the first base end 22 of the base portion 20 of the support member 10. The operative coupling between the first offset end 62 and the second upper end 44 and/or the second offset end 64 and the first base end 22 may be radiused, such as an upper offset radius 63 (e.g., first offset radius) and a lower offset radius 65 (e.g., second offset radius 65). The upper offset radius 63 and the lower offset radius 65 may have any size radius. It should be understood that radiused portions of the offset portion 60 may form the entirety of the offset portion, or the offset portion may have a straight portion between the upper offset radius 63 and the lower offset radius 65.

It should be understood that instead of having a single channel 80, as illustrated in FIGS. 1 through 11, the support member 10 may have two or more channels 80 that may run in parallel with each other from the base portion 20 through the offset portion 60 and/or through the upper portion 40. As such, there may be multiple upper flanges and multiple lower flanges operatively coupled by multiple webs in order to form the support member 10 with two or more channels 80. For example, the support member 10 may have a w-shape formed by two channels 80 running parallel to each other over a segment of the support member 80, or a portion thereof.

It should be further understood that while the channel 80 illustrated in the figures is continuous, the one or more channels 80 may be continuous or may be discontinuous within the support member 10 and/or each portion of the support member (e.g., within the base portion 20, the offset portion 60, and/or the upper portion 40). Consequently, the channel 80 may be located within the base portion 20, the offset portion 60, and/or the upper portion 40. Moreover, the channel 80 may extend completely through, or be located only within a portion of, the base portion 20, the offset portion 60, and/or the upper portion 40. As such, there may two or more channels 80 that extend in series with each other, but are separated from each other, within the support member 10 and/or the individual portions thereof (e.g., he base portion 20, the offset portion 60, and/or the upper portion 40).

It should be further understood that the operative coupling between the flanges 82, 84, 85 and the webs 86, 86 that forms the channel 80 may have any type of radius, may have an edge, or may have any other type of shape.

The support members 10 may be formed in a number of manufacturing process, such as but not limited to rolled formed and cut into the desired shape, stamped and folded into shape, stamped into the desired shape in one or more stamping processes (e.g., a single or multi-staged process), cut, folded and/or welded into the desired shape, mechanically fastened together, casted, 3D printed, or the like, and/or any combination thereof. Specifically, in some embodiments, the support members 10 may comprise a stamped part. Stamping the support member 10 in the desired configuration may reduce manufacturing costs while providing a plurality of support members 10 that can be cradled and/or nested inside of each other to save shipping space and costs. Moreover, as will be discussed in further detail herein, the support members 10 may be a single member which reduces the installation costs associated with installing the roof system 100, and in particular, installing multiple components between building support members 200 and roof clips 250.

Figure 8A:
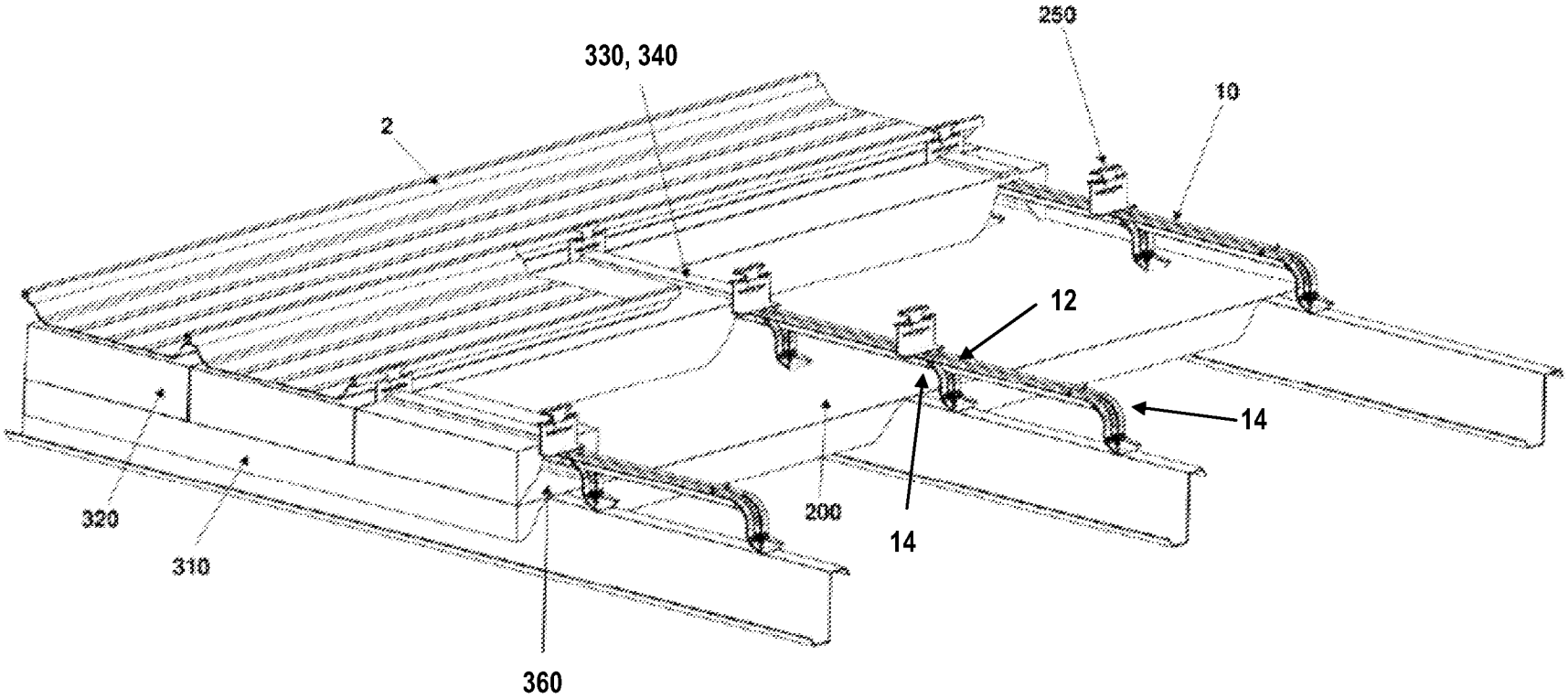
FIG. 8A illustrates a perspective view a roof insulation system with the support members installed, in accordance with embodiments of the present disclosure.
Figure 10:
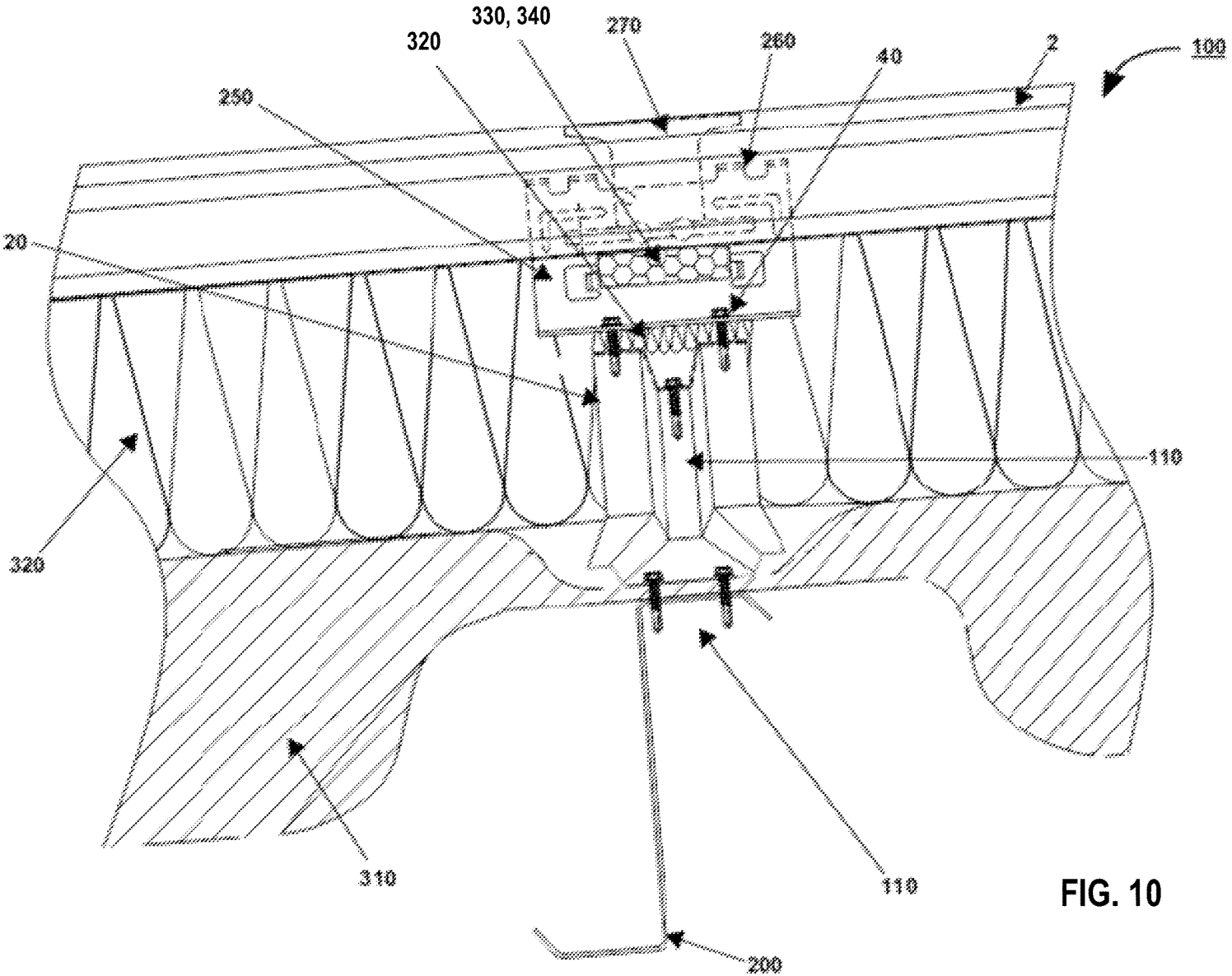
FIG. 10 illustrates a cross-sectional front view of a roof insulation system with a support member installed, in accordance with embodiments of the present disclosure.

Applicant notes that the roof insulation system 100 comprises a plurality of support members 10 and will be described in further detail with respect to FIGS. 8 through 11. Moreover, the method 400 of installing the roof insulation system 100 is described in further detail with respect to FIG. 12. As illustrated in FIG. 12, block 410 illustrates that building members 200 are installed into a building system 1. For example, the building members 200 may be vertical columns, rafters, girders, joists, purlins 220 (as illustrated in FIGS. 8A-8B and 10), or the like. In one example, purlins 220 may be installed onto rafters, trusses, girders, or the like of a building system 1 for newly constructed buildings (not illustrated). Alternatively, in some embodiments, purlins 220 or other like building components may be installed on a current roof in order to retrofit the roof with the roof insulation system 100 described herein.

Figure 11:
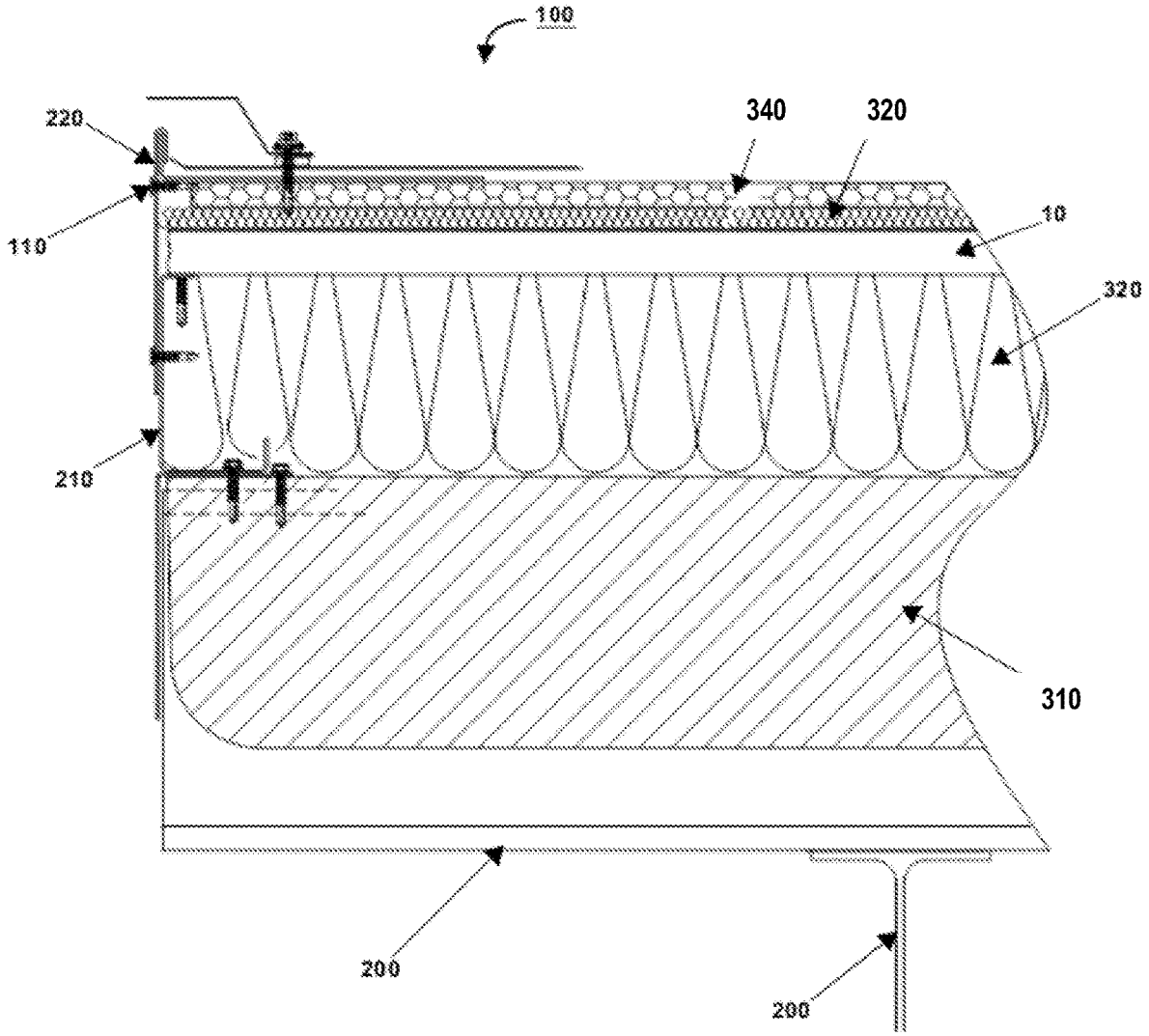
FIG. 11 illustrates a cross-sectional side view at a start or an end of a roof insulation system with a support member installed, in accordance with embodiments of the present disclosure.
Figure 12:
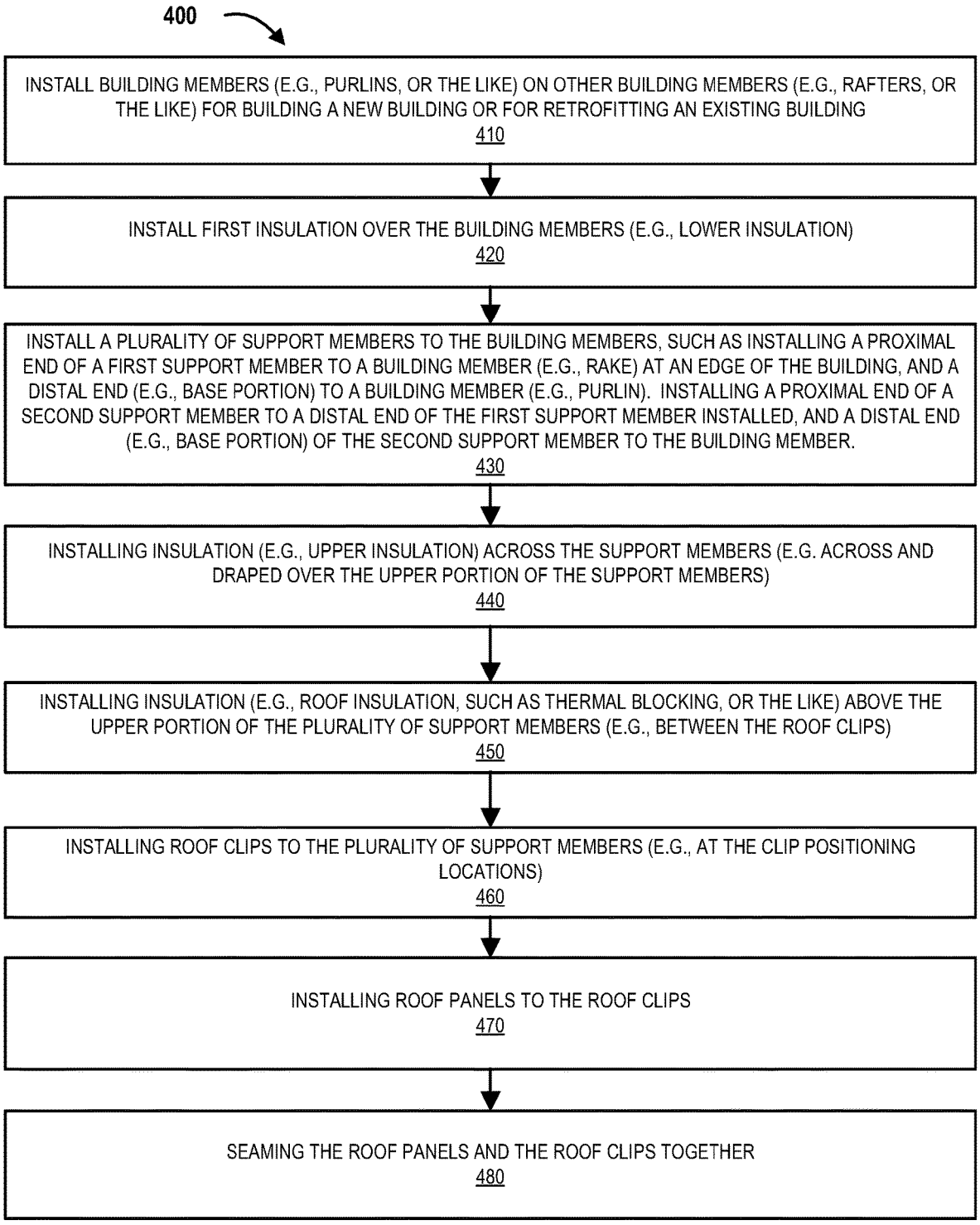
FIG. 12 illustrates a method of installing the roof insulation system, in accordance with embodiments of the present disclosure.

It should be understood that installing the building members may further include installing rakes 210 to the building members 200, as well as operatively coupling a rake clip 212 to the rakes 210, as illustrated in FIG. 11. Thereafter, a fastener 110 may be operatively coupled to the rake 210 and/or the rake clip 212. The rake 210 and/or the rake clip 212 may be utilized with a starter support member 10, as will be described in further detail below.

Block 420 of FIG. 12 illustrates that insulation 300 is installed over and/or around the building members 200. FIGS. 8A through 11 illustrate that the insulation 300 may comprise lower insulation 310 that may be installed transversely across the building members (e.g., transverse to the purlins 220, or the like). In some embodiments the lower insulation 310 may be compressible insulation as illustrated by FIGS. 8A-8C and 10. However, in other embodiments of the invention the lower insulation 310 may be not compressible, and thus, may be installed to the building members 200 in other ways. It should be understood that the lower insulation 310 may be installed before or after the support members 10 are installed.

FIG. 12 illustrates in block 430 that a plurality of support members 10 may be installed to the building members 200. In some embodiments, as illustrated in FIG. 10, the support members 10 may be installed over the lower insulation 310, and as such, the lower insulation 310 may be compressed between the base portion 20 of the support member 10 and the building members 200 (e.g., the purlins 220). However, in some embodiments the support members 10 may be installed to the building members (e.g., the purlins 220) without compressing the lower insulation 310 (e.g., compressible insulation is cut to size between offset portions 60 of adjacent support members 10, non-compressible insulation such as thermal insulation blocks are spaced between the support members 10, or the like).

As illustrated in FIG. 11, in some embodiments a first support member 10 (or starter support member) may be operatively coupled at its proximal end 12 (e.g., a first end, such as at the first upper end 42 of the upper portion 40) to a building member 200 adjacent an edge of the building system 1, such as adjacent a rake 210 of the building. In some embodiments the first support member 10 (or starter support member) may be cut to the desired length (or a specific pre-sized starter support member 10 may be utilized). Regardless of the size of the first support member 10, the proximal end 12 of the first support member 10 may be operatively coupled to the rake 210 (e.g., directly to a rake 210 at the rake channel, to the rake clip 212, or the like). The proximal end 12 of the support member 10 may be operatively coupled to a building member 200 (e.g., at the rake 210) at the edges of the building system 1 through any type of coupling (e.g., mechanical, adhesive, destructive, non-destructive, or the like). The mechanical connection may be tab(s), hook(s), finger(s), slot(s), fastener(s), shearing, and/or the like. In some embodiments, the coupling may be made through the use of one or more fasteners 110 (e.g., screws, bolts and nuts, nails, rivets, or any other type of fastener). For example, as illustrated in FIG. 11, the proximal end 12 (e.g., a first upper end 42) of the support member 10 may be operatively coupled to the building member 200 (e.g., rake 210) through the use of a screw (e.g., self-drilling screw, screw through a pre-formed aperture in the support member 10, or the like). Moreover, the distal end 14 of the first support member 10 is also operatively coupled to a building member 200. For example, the base portion 20 (e.g., the second base end 24, or the like) may be operatively coupled to a building member 200, such as to a purlin 220, through a coupling. Like the proximal end 12 of the first support member 10, any type of coupling may be used to operatively couple the distal end 14 of the first support member 10 to the building member 200. For example, a fastener 110 may be utilized to operatively couple the base portion 20 to the building member 200, such as to the purlin 220.

In some embodiments, after installation of the first support member 10 (e.g., starter support member 10), additional insulation 300 may be installed, as will be further described with respect to the upper insulation 320 in block 440 below. Additionally, a starter panel 2 and the clips 250 may be installed to the support member 10 (e.g., to the starter support member 10). For example, the starter panel 2 is laid on the starter support member 10, and the starter clips 250 are operatively coupled to the starter support member 10. For example, the clip positioning features 70 (e.g., positioning tabs 72) may be used to align the starter clips 250 on the starter support member 10. For example, the positioning apertures 74 and clip apertures 252 may be aligned by the positioning tabs 72. Couplings, such as fasteners 110 may be used to operatively couple the starter clips 250 to the starter support member 10.

After installation of the first support member 10, a second support member 10 is operatively coupled to the first support member 10 and the building member 200. For example, the proximal end 12 of the second support member 10 may be operatively coupled to the distal end 14 of the first support member 10, as illustrated in FIGS. 8 and 9. It should be understood that any type of coupling may be utilized to operatively couple the second support member 10 to the first support member 10, as will be described in further detail below. In some embodiments of the invention after the proximal end 12 of a second support member 10 is operatively coupled to the distal end 14 of a first support member 10, and before the distal end 14 of the second support member 10 is operatively coupled to the roof building member 200 (e.g., the purlin 220), additional components of the roof system 100 may be installed. For example, insulation 300 (e.g., the upper insulation 320) may be installed, as will be described with respect to block 440, before the distal end 14 of the second support member 10 is operatively coupled to the purlin 220. In this way, the alignment of the second support member 10 may be checked by the installer before the distal end 14 (e.g., the base portion 20) of the support member 10 is operatively coupled to the purlin 220. When the second support member 10 is properly aligned, couplings (e.g., fasteners 110) are used to operatively coupled the distal end 14 (e.g., the base portion 20) to the building member 200 (e.g., purlin 220).

Returning to FIG. 9, the coupling of adjacent support members 10 is described in further detail below. In one embodiment, as illustrated in FIG. 9, a first upper end 42 of the upper portion 40 of the second support member 10 may be operatively coupled to the second upper end 44 of the upper portion 40 of the first support member 10 in a number of ways. For example, as illustrated in FIG. 9, and as previously discussed herein, the proximal end 12 of the second support member 10 may comprise a nested portion 50 (e.g., a nested channel 90, or the like) and/or the distal end 14 of the first support member 10 may comprise an expanded portion (e.g., an expanded channel, or the like). As such, the nested portion 50 on the proximal end 12 (e.g., first upper portion end 42 otherwise described as a proximal upper portion end 42) of the upper portion 40 of the second support member 10 may be nested within the channel 80 on the distal end 14 (e.g., within second upper portion end 44 otherwise described as a distal upper portion end 44) of the first support member 10. As previously discussed herein, the nested portion 50 may comprise a nested channel 90 that is smaller than the support member channel 80. That is, the nested channel 90 may comprise a nested lower flange 92 and two nested upper flanges 94, 95, wherein the nested lower flange 92 of the nested channel 90 has a nested lower flange width that is less than the lower flange width of the lower flange 82 of the support member channel 80 of the first support member 10. As such, as illustrated in FIG. 9, the nested portion 50 (e.g., nested channel 90) of the second support member 10 may nest (e.g., fit within) the channel 80 of the first support member 10 adjacent the distal end 14 of the first support member 10. In some embodiments, the nested portion 50 of the second support member 10 may allow the outside of the channel 80 of the first support member to sit flush with the outside of the channel 80 of the second support member 80.

Additionally, or alternatively, and as previously discussed herein the expanded portion may comprise an expanded channel that is greater than the support member channel 80. That is, the expanded channel may comprise an expanded lower flange and two expanded upper flanges, wherein the expanded lower flange of the expanded channel has an expanded lower flange width that is greater than the lower flange width of the lower flange 82 of the support member channel 80 of the first support member 10. As such, the expanded portion (e.g., expanded channel) of the first support member 10 may cradle (e.g., receive within, or the like)

the channel 80 of the second support member 10 adjacent the distal end 14 of the first support member 10. In some embodiments, the expanded portion of the first support member 10 may allow the interior surface of the channel 80 of the second support member 10 to sit flush with the remaining portion of the interior channel 80 of the first support member 10.

In addition to the nested portion 50 and/or the expanded portion discussed herein, or alternative to the foregoing, the first support member 10 may be operatively coupled to the second support member 10 using any type of coupling. For example, one or more fasteners 110 may be used to operatively couple the proximal end 12 of the second support member 10 to the distal end 14 of the first support member 10. The proximal end 12 (e.g., first upper end 42 of the upper portion 40) may comprise one or more proximal end apertures (e.g., one or more channel apertures, nested apertures, or the like), while the distal end 14 (e.g., the second upper end 44 of the upper portion 40) may comprise one or more distal end apertures (e.g., one or more channel apertures, expanded apertures, or the like). The proximal end apertures and/or distal end apertures may be used along with one or more fasteners 110 in order to operatively couple the proximal end 12 of a second support member 10 to the distal end 14 of a first support member 10.

It should be understood, as previously discussed herein, the proximal end 12 of the second support member 10 may be operatively coupled to the distal end 14 of the first support member 10 through any type of coupling, such as tabs, hooks, fingers, slots, apertures, or the like that are operatively coupled to other tabs, hooks, fingers, slots, apertures, or the like.

After installation of the second support member 10, third, fourth, fifth, or the like support members 10 may be installed in the same or similar way along the length of the building member 200 (e.g., purlin 220, or the like) of the building system 1 in order to support the roof panels 2 and allow for additional insulation 300 as discussed in further detail below. Blocks 440 through 480 are described below with respect installing insulation 300, roof clips 250, and roof panels 2 to the support members 10. It should be understood that the insulation 300, roof clips 250, and roof panels 2 may be installed as the individual support members 10 are installed, as described with respect to the starter support member 10 above. Alternatively, the insulation 300, roof clips 250, and roof panels 2 may be installed after a plurality of the support members 10 are installed. It should be further understood that the ending support member 10 may be installed in the same or similar way as was described with respect to the starter support member 10. That is, the ending support member 10 may be modified in the field (e.g., cut, or the like) to adjust the length of the ending support member 10. For example, the offset portion 60 and the base portion 20 of the support member 20 may be removed along with a portion of the upper portion 40, such that only a straight portion of the support member 10 remains. Consequently, the ending support member 10 may be operatively coupled to an edge of a building member 200 (e.g., to the rake 210) and to a distal end 14 of an adjacent support member 10, as previously described herein.

Figure 8C:
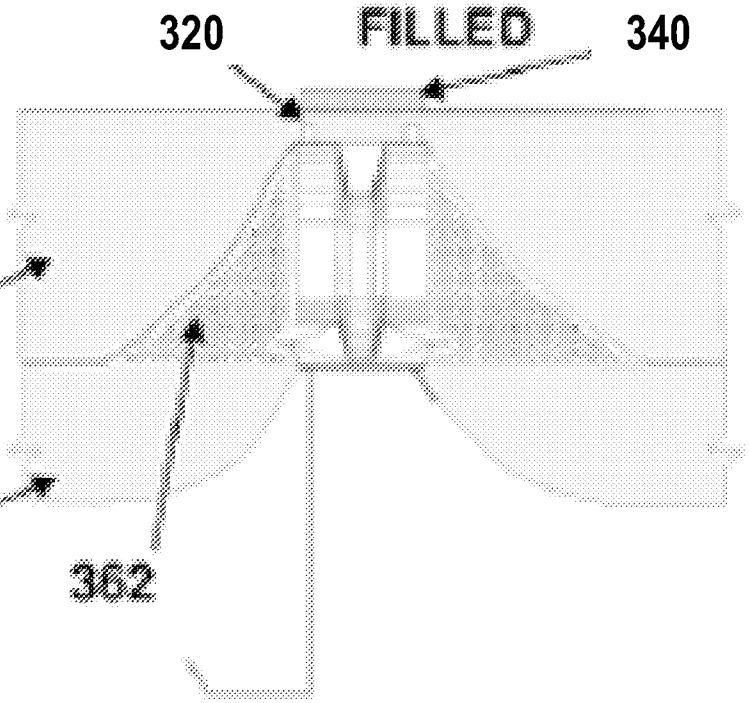
FIG. 8C illustrates a cross-sectional end view of a roof insulation system with the support members installed, in accordance with embodiments of the present disclosure.
Figure 8B:
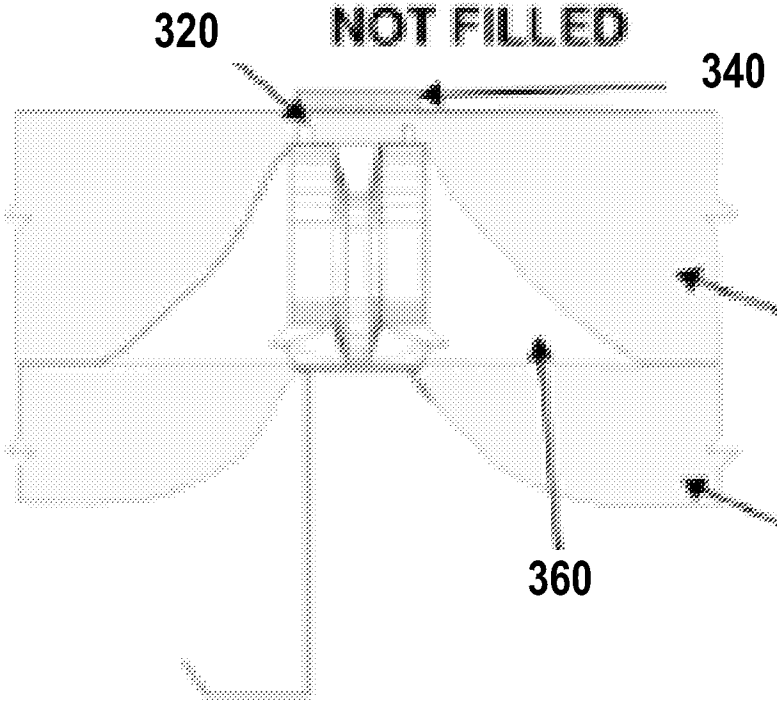
FIG. 8B illustrates a cross-sectional end view of a roof insulation system with the support members installed, in accordance with embodiments of the present disclosure.

Block 440 of FIG. 12, illustrates that insulation 300 may be installed over the upper portion 40 of the support members 10 transversely to the support members 10 and the building members 200 (e.g., purlins 220, or the like) on which the support members 10 are operatively coupled (e.g., over the upper portion 40 of the support members 10 as illustrated in FIGS. 8A-8C). The insulation 300 may be upper insulation 320 (e.g., multiple sections of upper insulation 320) that are spaced apart such that one or more upper insulation sections 320 may fit between adjacent clips 250. In other embodiments the clips 250 may be installed over the upper insulation 320, and thus, compress the upper insulation between the clip 250 and the support member 10. The upper insulation 320 sits above the lower insulation 310 and provides additional insulation to the roof system 100 in order to improve upon heat transfer between the inside and outside of the building system 1.

As illustrated in block 450 of FIG. 12, additional insulation 300 may be placed over the support members 10 (e.g., between adjacent clips 250) in order to provide additional heat transfer protection for the roof insulation system 100. As illustrated in FIGS. 8A-11, the roof insulation 330 placed above the support members 10 may be one or more thermal insulation blocks 340 (e.g., non-compressible portions of insulation). The clips 250 may have clip insulation tabs 256, which could be used for operatively coupling with thermal insulation blocks 340, in order to keep the thermal insulation blocks 340 in place.

As illustrated in FIGS. 8B and 8C, it should be understood that the insulation 300, in particular the upper insulation 320 draped over the support member 10, may create a void 360 area beneath the support member 10 (e.g., between the upper portion 40 of the support member 10 and the building member 200—e.g., the purlin 220, adjacent the upper portion 40 and the building member 200, or the like). In some embodiments, the void 360 will not be filled, as illustrated in FIG. 8B. Alternatively, as illustrated in FIG. 8C, in some embodiments the void 360 may be be filled with insulation 300, such as support member insulation 362 (e.g., compressible, non-compressible, foam, or the like).

Moreover, FIG. 12 further illustrates in block 460, that a plurality of roof clips 250 (otherwise described as panel clips) are operatively coupled to the support members 10 at the desired locations. The roof clips 250 may be any type of roof clip 250 used to operatively couple roof panels 2 to the building support members 10 and/or the building members 200. In some embodiments, the roof clips 250 may comprise a base clip portion 260 and a connector clip portion 270. The base clip portion 260 and the connector clip portion 270 may move with respect to each other in order to allow the connector clip portion 270 to move the with the roof panels 2 as the base clip portion 260 stays static with the support members 10. As such, the roof clips 250 allow the roof panels 2 to move due to thermal expansion and contraction.

In some embodiments of the invention the clips 250 may be operatively coupled to support members 10 at clip coupling locations, such as at pre-determined locations. In some embodiments, the support members 10 may comprise one or more clip positioning features 70, such as apertures (e.g., through which clip fasteners, projections, or the like may be used to operatively couple the clips 250 to the support members), projections (e.g., tabs, extensions, or the like that may be inserted into an aperture in the clips, fasten to the clips, butt up against the clips, or the like), or other like clip couplings that may be used to create pre-determined locations for coupling the clips 250. In some embodiments, the clip positioning features 70 may comprise one or more positioning tabs 72, positioning apertures 74, and/or other features. The clip positioning features 70 may provide specific features at specific locations order to operatively couple clips 250 based on the length of the one or more support members 10 and/or the width of the panels 2 of the roof system 100. For example, in some embodiments clips 250 may be butted up against the positioning tabs 72, and couplings, such as fasteners 110, may be used to operatively couple the clips 250 to the support member 10 at the clip positioning feature 70. In some embodiments, the clip base portion 260 may have clip apertures 252, and the fasteners 110 may extend through the clip apertures 252 in the clip base portion 270 and through the positioning apertures 74 in the support member 10. In other embodiments of the invention, the clips 250 may be coupled to the support member 10 where necessary based on the locations where the edges of the adjacent roof panels 2 are located, or are going to be located.

Furthermore, as illustrated by block 470 of FIG. 12, a plurality of roof panels 2 may be installed over the support members 10, roof insulation 330, and/or the clips 250. As illustrated in FIGS. 9 and 10, the panel edges of each panel 2 may be operatively coupled to each other by placing a portion of a folded edge of one panel 2 under an edge of the panel clips 250 (e.g., edge of a connector clip portion 270), and by placing a folded edge of an adjacent panel 2 over the clip 250 and/or by placing a folded portion of the edge of one panel 2 over the edge of another panel 2 where the clips 250 are not located.

FIG. 12 further illustrates in block 480 that the edges of the panels 2 and/or the clips 250 (e.g., edge of connector clip portion 270) where the clips 250 are located are seamed together. The seeming of the edges of the panels 2 (including the clips 250) may create a watertight seam in order to resist the flow of water between panels 2. As such, in some embodiments portions of the edges of the panels 2 and/or the clips 250 (e.g., connector clip portion 270 edges) are further folded, bent, and/or sheared (e.g., cut, or the like) together in order to operatively couple the panels 2 and the clips 250 to each other. In other embodiments, other couplings may be utilized to operatively couple the adjacent panels edges to each other and/or to the clips.

The roof insulation system 100, and the support members 10 thereof, as described herein provide improvements over traditional insulated roof systems. For example, the roof system 100 described herein provides improved thermal resistance over traditional roof systems. As such, embodiments of the roof system 100 described herein achieve compliance with updated energy codes by way of using the support members 10. Consequently, the roof systems 100 having the support members 10 achieve the required thermal resistance while providing better, the same, or similar structural support and costs in its production, transportation, and installation.

In some embodiments, the support members 10 described herein may provide improved structural support over some traditional systems. For example, the one or more channels 80 of the one or more support members 10 described herein provide improved structural support to the roof systems 100. The deep channel provides support, and moreover, the large width of the upper flanges 84, 85 provides a stable location on which to secure the clips 250 (e.g., as opposed to a narrower single flat surface around which the width of a clip 250 may overhang, or on which a narrower clip may be required). Furthermore, the base portion 20 of the support members 10 provides a wide location, such as through the diverging channel, to operatively couple the support members 10 to the underlying building members 200, such as the purlins 220. The base portion 20 provides for improved installation with a building member 200 without sacrificing structural support of the support member 10.

Furthermore, with respect to shipping, since the one or more support members 10 may be nested and/or cradled with respect to each other through the use of the channels 80, shipping space is more efficient and thus, shipping costs are reduced. Further, because the support members 10 are made of a single component and can be operatively coupled to each other and the building members 200, additional components (e.g., other than fasteners), such as additional brackets, spacers, stand-offs, blocks, or the like, are not required for installation of the support members 10, thus reducing the installation complexity, time, and costs.

It should be understood that "operatively coupled," when used herein, means that the components may be formed integrally with each other, or may be formed separately and coupled together. Furthermore, "operatively coupled" means that the components may be formed directly to each other, or to each other with one or more components located between the components that are operatively coupled together. Furthermore, "operatively coupled" may mean that the components are detachable from each other, or that they are permanently coupled together.

It should be understood that parallel may mean that the components are oriented in the same direction about 0 degrees with respect to each other, while substantially parallel may mean that the components are oriented in the same direction between the range of about −15 to about +15, while generally parallel may mean that the components are orientated between about −45 to about 45 degrees with respect to each other. It should be understood that these ranges described herein may vary by +/−1, 2, 3, 4, 5, 6, 7, 8, 9, 10 degrees. It should be understood that perpendicular may mean that the components are oriented about 90 degrees from each other, while substantially perpendicular may mean that the components are oriented between the range of about 75 to about 105 degrees, while generally perpendicular may mean that the components are orientated between about 45 to about 135 degrees with respect to each other. It should be understood that these ranges described herein may vary by +/−1, 2, 3, 4, 5, 6, 7, 8, 9, 10 degrees.

Certain terminology is used herein for convenience only and is not to be taken as a limitation on the embodiments described. For example, words such as "proximal", "distal", "first", "second", "top", "bottom", "upper", "lower", "left", "right", "horizontal", "vertical", "upward", "downward", "parallel", and/or "perpendicular" merely describe the configuration shown in the figures and/or from the reference point of an observer located at a particular location. Indeed, the referenced components may be oriented in any direction and the terminology, therefore, should be understood as encompassing such variations unless specified otherwise. Throughout this disclosure, where a process or method is shown or described, the method may be performed in any order or simultaneously, unless it is clear from the context that the method depends on certain actions being performed first.

Also, it will be understood that, where possible, any of the advantages, features, functions, devices, and/or operational aspects of any of the embodiments of the present invention described and/or contemplated herein may be included in any of the other embodiments of the present invention described and/or contemplated herein, and/or vice versa. In addition, where possible, any terms expressed in the singular form herein are meant to also include the plural form and/or vice versa, unless explicitly stated otherwise. Accordingly, the terms "a" and/or "an" may mean "one or more."

While certain exemplary embodiments have been described and shown in the accompanying drawings, it is to be understood that such embodiments are merely illustrative of and not restrictive on the broad invention, and that this invention is not limited to the specific constructions and arrangements shown and described, since various other changes, combinations, omissions, modifications and substitutions, in addition to those set forth in the above paragraphs, are possible. Those skilled in the art will appreciate that various adaptations, modifications, and combinations of the just described embodiments can be configured without departing from the scope and spirit of the invention. Therefore, it is to be understood that, within the scope of the appended claims, the invention may be practiced other than as specifically described herein.

What is claimed is:

1. A support member for a roof system, comprising:

a base portion extending in a first direction;

an upper portion extending in a second direction opposite the first direction having a first upper end and a second upper end; and an offset portion operatively coupling the base portion to the second upper end of the upper portion;

wherein the upper portion is longer than the base portion;

wherein a base portion width of the base portion is greater than an upper portion width of the upper portion or an offset portion width of the offset portion; and wherein the first upper end of the upper portion is configured to be operatively coupled with a second upper end of an upper portion of an adjacent support member.

2. The support member of claim 1, wherein the base portion, the upper portion, and the offset portion of the support member is a unitary stamped part.

3. The support member of claim 1, wherein the base portion, the upper portion, or the offset portion comprises a channel.

4. The support member of claim 3, wherein the channel extends from the base portion through the offset portion and into the upper portion.

5. The support member of claim 3, wherein the channel comprises:

a lower channel flange;

two upper channel flanges; and two webs operatively coupling the lower channel flange to the two upper channel flanges.

6. The support member of claim 3, wherein the channel comprises:

a first upper channel flange and a second upper channel flange;

a first web and a second web; and a lower channel flange;

wherein the first web operatively couples the lower channel flange and the first upper channel flange, and wherein the second web operatively couples the lower channel flange to the second upper channel flange.

7. The support member of claim 3, wherein the channel is within the base portion and the offset portion, and wherein the channel diverges within the base portion towards the channel in the offset portion.

8. The support member of claim 3, wherein at least a portion of the channel of the base portion has a base channel width greater than an upper portion channel width of the upper portion or an offset portion channel width of the offset portion.

9. The support member of claim 1, wherein the offset portion is operatively coupled to the upper portion through an upper radiused bend and wherein a channel extends through the upper radiused bend.

10. The support member of claim 1, wherein the offset portion is operatively coupled to the base portion through a lower radiused bend and wherein a channel extends through the lower radiused bend.

11. The support member of claim 1, wherein the first upper end comprises a nested end, wherein the nested end comprises a nested channel comprising:

a nested lower channel flange:

a first nested upper channel flange and a second nested upper channel flange; and a first nested channel web and a second nested channel web;

wherein the first nested channel web operatively couples the nested lower channel flange and the first nested upper channel flange, and wherein the second nested channel web operatively couples the lower nested channel flange to the second nested upper channel flange; and wherein the nested lower channel flange has a lower nested flange width that is less than a lower channel flange width of the upper portion.

12. A roof system comprising:

a plurality of building members;

a plurality of support members operatively coupled to at least one of the plurality of building members, wherein each of the plurality of support members comprise:

a base portion extending in a first direction;

an upper portion extending in a second direction opposite the first direction having a first upper end and a second upper end, wherein the upper portion is longer than the base portion; and an offset portion operatively coupling the base portion to the second upper end of the upper portion;

wherein a base portion width of the base portion is greater than an upper portion width of the upper portion or an offset portion width of the offset portion; and wherein the first upper end of a first support member of the plurality of support members is operatively coupled to the second upper end of a second support member of the plurality of support members, wherein the second support member is adjacent the first support member.

13. The roof system of claim 12, wherein the base portion, the upper portion, or the offset portion comprises a channel.

14. The roof system of claim 13, wherein the channel extends from the base portion through the offset portion and into the upper portion.

15. The roof system of claim 13, wherein the channel comprises:

a lower channel flange;

two upper channel flanges; and two webs operatively coupling the lower channel flange to the two upper channel flanges.

16. The roof system of claim 13, wherein the channel comprises:

a first upper channel flange and a second upper channel flange;

a first web and a second web; and a lower channel flange;

wherein the first web operatively couples the lower channel flange and the first upper channel flange, and wherein the second web operatively couples the lower channel flange to the second upper channel flange.

17. The roof system of claim 13, wherein the channel is within the base portion and the offset portion, wherein at least a portion of channel of the base portion has a base channel width greater than an offset portion channel width of the offset portion, and wherein the channel diverges within the base portion towards the channel in the offset portion.

18. The roof system of claim 13, wherein the offset portion is operatively coupled to the upper portion through an upper radiused bend and the offset portion is operatively coupled to the base portion through a lower radiused bend, and wherein the channel extends through the upper radiused bend and the lower radiused bend.

19. The roof system of claim 12, wherein the first upper end comprises a nested end, wherein the nested end comprises a nested channel comprising:

a nested lower channel flange:

a first nested upper channel flange and a second nested upper channel flange; and a first nested channel web and a second nested channel web;

wherein the first nested channel web operatively couples the nested lower channel flange and the first nested upper channel flange, and wherein the second nested channel web operatively couples the lower nested channel flange to the second nested upper channel flange; and wherein the nested lower channel flange has lower nested flange width that is less than a lower channel flange width of the upper portion; and wherein the nested channel at the first upper end of the first support member nests within the second upper end of the second support member.

20. A method of installing a roof system, comprising:

assembling a plurality of support members to a building member, wherein the plurality of support members comprises:

a base portion extending in a first direction;

an upper portion extending in a second direction opposite the first direction having a first upper end and a second upper end, wherein the upper portion is longer than the base portion; and an offset portion operatively coupling the base portion to the second upper end of the upper portion;

wherein a base portion width of the base portion is greater than an upper portion width of the upper portion or an offset portion width of the offset portion;

wherein the first upper end of a first support member of the plurality of support members is operatively coupled to the second upper end of a second support member of the plurality of support members, wherein the second support member is adjacent the first support member;

assembling insulation between or above the plurality of support members;

assembling a plurality of clips to the plurality of support members; and assembling a plurality of panels to the plurality of clips.

* * * * *